United States Patent [19]

Schlott

[11] 4,141,330

[45] Feb. 27, 1979

[54] PRESSURE REGULATING VALVE FOR FUEL INJECTION SYSTEMS

[75] Inventor: Walter Schlott, Rommelshausen, Fed. Rep. of Germany

[73] Assignee: Robert Bosch GmbH, Stuttgart, Fed. Rep. of Germany

[21] Appl. No.: 798,522

[22] Filed: May 19, 1977

[30] Foreign Application Priority Data

May 22, 1976 [DE] Fed. Rep. of Germany ..... 2623122

[51] Int. Cl.[2] ..... F02M 39/00; F02M 1/02

[52] U.S. Cl. ..... 123/139 AW; 123/139 BG; 261/39 E; 261/50 A

[58] Field of Search ..... 123/139 AW, 139 AB, 123/139 BG, 119 F; 261/50 A, 36 A, 39 A, 39 E, 121 B

[56] References Cited

U.S. PATENT DOCUMENTS

| | | | |
|---|---|---|---|
| 3,777,727 | 12/1973 | Kitchner et al. | 123/139 AW |
| 3,835,828 | 9/1974 | Knapp | 123/139 AW |
| 3,963,005 | 6/1976 | Eckert | 123/139 AW |
| 3,993,034 | 11/1976 | Passera et al. | 123/139 AW |
| 4,038,955 | 8/1977 | Paulmier | 123/119 F |

*Primary Examiner*—Charles J. Myhre
*Assistant Examiner*—P. S. Lall
*Attorney, Agent, or Firm*—Edwin E. Greigg

[57] ABSTRACT

There is proposed a pressure regulating valve for a fuel injection system which serves to regulate the heating-up fuel amount for an explosion, external auto-ignition, internal combustion engine. The pressure regulating valve comprises a movable valve component which is urged in the closing direction by a pressure spring which during the heating-up phase acts against a temperature responsive element which in turn acts with a force that can be influenced by another temperature responsive electrically heatable element so that during the heating-up phase the air-fuel mixture can be proportioned in accordance with the requirements of each internal combustion engine.

5 Claims, 2 Drawing Figures

PRESSURE REGULATING VALVE FOR FUEL INJECTION SYSTEMS

BACKGROUND OF THE INVENTION

The invention relates to improvements in a pressure regulating valve for a fuel injection system for an explosion, external auto-ignition, internal combustion engine having a suction duct in which there is arranged an air-flow sensor member which is displaced by the amount of air flowing through it against the restoring force produced by the pressure fluid. The arrangement is such that the pressure fluid being continuously conveyed in the control pressure conduit under constant pressure which is changeable at will by means of the pressure regulating valve with the movable valve component of the pressure regulating valve at one side thereof being under the action of the pressure fluid and with that at the other side under the action of the pressure spring so that the force of the pressure spring can be decreased by a temperature-responsive element. Further a pressure regulating valve for a fuel injection system is also known in which the temperature-responsive element is heated up immediately after start by an electrical heating coil, however, this results in a too fast reduction in the fuel enrichment during the heating-up phase.

OBJECT AND SUMMARY OF THE INVENTION

The primary object of this invention has the advantage that a reduction in fuel enrichment is delayed during the heating-up phase of the internal combustion engine.

Another particular advantage of the invention is the almost arbitrary course of the regulation-delaying characteristic curve of the pressure regulating valve.

Another advantage is the accurately adjustable simple and economical construction of the pressure regulating valve.

Still another advantage in this novel concept is that bimetallic springs are used as the temperature-responsive elements.

These and other objects and advantages of the present invention will be more readily apparent from a further consideration of the following detailed description of the drawing illustrating a preferred embodiment of the invention, in which:

DESCRIPTION OF THE PREFERRED EMBODIMENT

Figure 1:
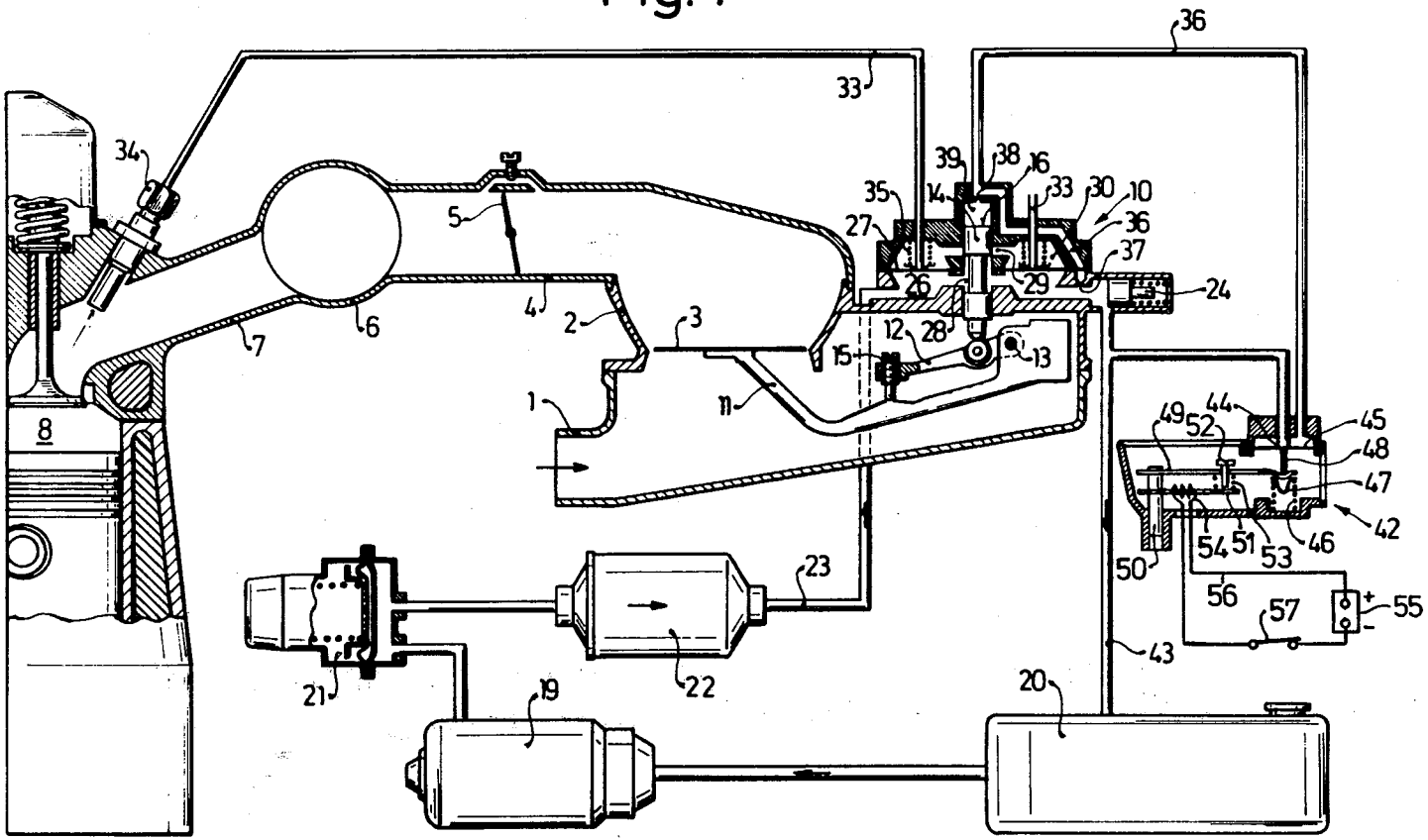
FIG. 1 shows schematically, in both cross section and elevation, the structural components required for a successful operation of the invention.

Turning now to the drawing, in the fuel injection system illustrated in FIG. 1, the air for combustion flows in the direction of the arrow via a suction pipe section 1 in a conical passage 2 in which there is disposed an air-flow sensor member 3 and also through a suction pipe section 4 having a throttle valve 5 controllable at will to a common intake manifold 6 and from there to one or more cylinders 8 of an internal combustion engine via a suction pipe section 7. The air-flow sensor member 3 is a plate arranged transverse to the direction of flow, which moves within the conical passage 2 of the suction pipe approximately in accordance with a linear function of the amount of air flowing through the suction pipe, whereby for a constant restoring force applied to the air-flow sensor member 3 and for a constant air pressure prevailing before the air-flow sensor member 3, the pressure existing between the air-flow sensor member 3 and the throttle valve 5 also remains constant. The air-flow sensor member 3 controls a metering and distributing valve 10. The regulation movement of the air-flow sensor member 3 is transmitted by a rocking lever 11 connected thereto which together with an adjustment lever 12 is mounted on a fulcrum point 13 and upon being pivoted actuates the movable valve component in the form of a control plunger 14 of the metering and distributing valve 10. The desired fuel-air mixture can be regulated by a mixture regulating screw 15. The front face 16 of the control plunger 14 facing away from the rocking lever 11 is urged by pressure fluid, the force of which applied to the front face 16 constitutes the restoring force acting on the air-flow sensor member 3.

The fuel is supplied by means of an electric fuel pump 19 which pumps the fuel out of a fuel tank 20 and supplies it to the metering and distributing valve 10 via a fuel accumulator 21, a fuel filter 22 and a fuel feeding conduit 23. A system pressure regulator 24 maintains the pressure of the system in the fuel injection system constant.

The fuel feeding conduit 23 opens via various branches into chambers 26 of the metering and distributing valve 10 so that one side of the diaphragm 27 will be affected by the fuel pressure. The chamber 26 also communicates with an annular tee-slot 28 of the control plunger 14. Depending on the position of the control plunger 14, the annular tee-slot 28 opens to a greater or lesser extent metering slits 29, each of which communicates with a respective chamber 30 that is separated from the chamber 26 by a diaphragm 27. From the chamber 30 fuel is supplied to the individual injection valves 34 by way of injection conduits 33, each injection valve being arranged in the suction pipe section 7 in the vicinity of the motor cylinder 8. The diaphragm 27 serves as a movable member of a flat seat valve which is retained in an open position by a spring when the fuel injection system is not in operation. The siphon diaphragms obtained in each chamber 26 and 30 act so that regardless of the overhead existing between the annular tee-slot 28 and the metering slits 29 and of the amount of fuel flowing towards the injection valves 34 the pressure gradient at the metering valves 28, 29 remains substantially constant. In this manner, there is ensured that the adjusting path of the control plunger 14 and the amount of fuel to be measured are proportional.

When the rocking lever 11 is pivoted, the air-flow sensor member 3 positioned in the conical passage 2 is inclined so that the altering transverse section between the air-flow sensor member and the cone is substantially proportional to the regulation movement of the air-flow sensor member 3.

The pressure fluid producing the restoring force acting on the control plunger 14 is the fuel. Thus, a control pressure conduit 36 branches off the fuel feed conduit 23 and is separated from the fuel feed conduit 23 by means of a decoupling choke bore 37. The control pressure conduit 36 communicates with a pressure space 39 via a damping choke bore or port 38, the control plunger 14 having its front face 16 arranged to extend into the space 39.

A pressure regulating valve 42 is arranged in the control pressure conduit 36 and through it pressure fluid can return to the fuel tank through a pipe 43. The force of the pressure fluid generating the restoring force during the heating-up phase of the internal combustion engine can be regulated in accordance with a temperature/time function by means of pressure regulating valve 42.

The pressure regulating valve 42 in this invention is in the form of a flat seat valve having a fixed valve seat 44 and a diaphragm 45 which serves as a movable valve component, the diaphragm 45 being urged in the direction of closure of the valve by a pressure spring 46. The pressure spring 46 acts on the diaphragm 45 by means of a spring cap 47 and a transmission stud 48. At temperatures below the operational temperature of the engine of about +80° C. the force of the spring 46 overcomes the force of a first temperature-responsive element in the form of a bimetallic spring 49. The first bimetallic spring 49 at its end which is positioned away from the pressure spring 46 is fixed to a bolt 50 to which there is also secured a second temperature-responsive element in the form of a second bimetallic spring 51. The second bimetallic spring 51 can engage by means of a set screw 52 which serves as an adjustable stop with the first bimetallic spring 49 at its free end. Between the first bimetallic spring 49 and the second bimetallic spring 51 there is also arranged a transmission spring 53. The second bimetallic spring can be heated by means of an electrical heating coil 54 which is connected to the vehicle battery 55 and its circuit 56 can be closed by the ignition and starter switch 57.

OPERATION

The operation of the pressure valve 42 is as follows: At temperatures higher than about +80° C. the first bimetallic spring 49 is bent so far in the direction toward the diaphragm 45 that it disengages from the pressure spring 46 so that the control pressure regulated by the pressure regulating valve 42 is governed exclusively by the force of the pressure spring 46 in the control pressure conduit 36. Below an operational temperature of the engine of about +80° C. it is necessary to enrich the air-fuel mixture with fuel during the heating-up phase of the internal combustion engine. For this purpose, according to the invention, there is employed a first bimetallic spring 49 through which the force of the pressure spring 46 on the diaphragm 45 can be reduced, the bimetallic spring 49 being capable of being influenced by the second bimetallic spring 51. There is also obtained a reduction in the closing force on the diaphragm 45 by means of the pressure spring 46 so that a smaller control pressure prevails on the control pressure conduit 36 and consequently the restoring force on the control plunger 14 and thus on the air-flow sensor member is also reduced. Thus, if the amount of air sucked in remains the same, the control plunger 14 will be displaced to a further extent in the opening direction of the control slits 29 and a larger amount of fuel will be metered. To ensure a safe start and continuous running of the internal combustion engine at low temperatures it is necessary that the decrease in fuel enrichment is delayed. To this end, there is provided the second bimetallic spring 51 on which an electrical heating coil 54 is arranged, the circuit 56 of which is closed by the ignition and start switches 57, and which acts as a timer circuit. The second bimetallic spring 51 first comes into contact with the first bimetallic spring 49 at a predetermined temperature, e.g., about +20° C., by means of the set screw 52 and causes a decrease in the force of the first bimetallic spring 49 which acts on the pressure spring 46. Owing to the presence of the transmission spring 53 between the bimetallic springs 49 and 51 there is obtained a continuous change of the contact point of both bimetallic springs.

Figure 2:
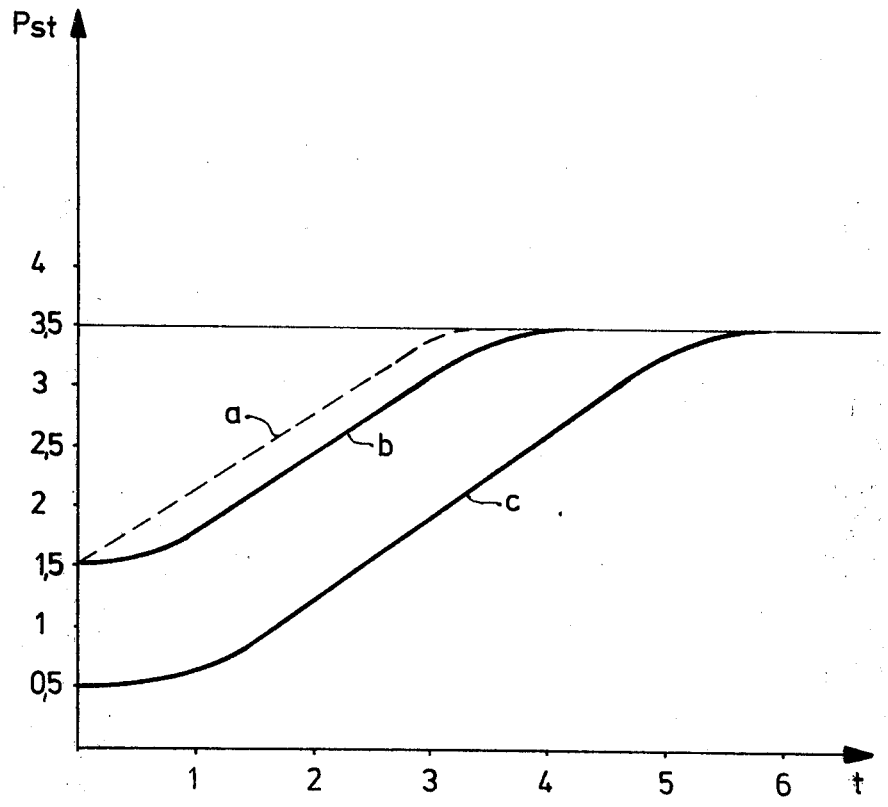
FIG. 2 is a diagrammatic showing of the pressure being governed by the pressure regulating valve against time.

In the diagram of FIG. 2, t indicates time in minutes and $P_{St}$ the control pressure in bar developed by the pressure regulating valve in the control pressure conduit 36. The dashed line a indicates the present course of the characteristic curve of a known pressure regulating valve at a start temperature of about +20° C. The line b indicates the course at about +20° C. of the pressure regulating valve 42 in accordance with the invention and curve c shows the course at −20° C. Accordingly, the decrease is delayed by comparison with the conventional characteristic curve.

The course of the characteristic curve can be modified in the case of the pressure regulating valve 42 according to the invention by choosing the distance between the second bimetallic spring 51 and the set screw 52, by varying the distance between the two bimetallic springs 49 and 51, and by suitably choosing the two bimetallic springs.

The disclosure of application Ser. No. 683,401, filed May 5, 1976 in the name of Reinhard Schwartz et al and now owned, by reason of assignment, by the assignee of this application is incorporated herein by reference.

The foregoing relates to a preferred exemplary embodiment of the invention, it being understood that other embodiments and variants thereof are possible within the spirit and scope of the invention, the latter being defined by the appended claims.

What is claimed is:

1. A pressure regulating valve for a fuel injection system for a mixture-compressing, externally ignited, internal combustion engine having a suction duct including an air-flow sensor member which is displaced by the amount of air flowing through it against the restoring force produced by a pressure fluid, said pressure fluid being continuously conveyed to a control pressure conduit under constant pressure and changeable at will by means of said pressure regulating valve, said pressure regulating valve further including a movable valve component one side of which is under the action of said pressure fluid and the other side thereof being under the action of a pressure spring with the force of the pressure spring being decreasable by a first temperature-responsive element further characterized in that a second temperature responsive element is arranged in said pressure regulating valve for engagement with said first temperature-responsive element so that said second temperature-responsive element acts in the direction of reducing the force of said first temperature-responsive element on the pressure spring.

2. A pressure regulating valve as claimed in claim 1, further characterized in that an electrical heating coil is associated with said further temperature-responsive element and the circuit of the coil being closed by the ignition and start switches of the internal combustion engine.

3. A pressure regulating valve as claimed in claim 2, further characterized in that said temperature responsive elements comprise bimetallic spring means.

4. A pressure regulating valve as claimed in claim 3, characterized in that said first bimetallic spring means and said second bimetallic spring means have an adjustable insert interposed therebetween.

5. A pressure regulating valve as claimed in claim 4, further characterized in that said first and said second bimetallic spring means are arranged to cooperate with a transmission spring with said first and second bimetallic spring means being in contact above a predetermined temperature by means of said adjustable insert.

* * * * *